United States Patent [19]

King et al.

[11] 4,312,268

[45] Jan. 26, 1982

[54] APPARATUS AND METHOD FOR COATING OF INKS APPLIED AT HIGH SPEED

[75] Inventors: George E. King; Hugh B. Skees, both of Dayton, Ohio

[73] Assignee: The Standard Register Company, Dayton, Ohio

[21] Appl. No.: 101,493

[22] Filed: Dec. 10, 1979

[51] Int. Cl.[3] ..... B05B 1/08

[52] U.S. Cl. ..... 101/1; 346/75; 118/636; 427/27

[58] Field of Search ..... 101/426, 1 R, DIG. 13; 400/126; 346/75; 118/636, 642, 653-655; 427/27, 29, 30, 372, 381

[56] References Cited

U.S. PATENT DOCUMENTS

| | | | |
|---|---|---|---|
| 2,910,964 | 11/1959 | Stavrakis et al. | 118/654 |
| 2,972,331 | 2/1961 | Umberger | 118/654 |
| 3,083,116 | 3/1963 | Berndt | 427/27 X |
| 3,115,814 | 12/1963 | Kaprelian | 118/653 X |
| 3,140,199 | 7/1964 | York | 118/653 X |
| 3,440,076 | 4/1969 | Vaurio | 427/27 X |
| 3,441,437 | 4/1969 | Epstein et al. | 118/654 X |
| 3,446,184 | 5/1969 | Johnson | 118/654 X |
| 3,640,749 | 2/1972 | Lorenz | 427/27 X |
| 3,911,160 | 10/1975 | Neuberg | 101/426 X |

OTHER PUBLICATIONS

"Liquid Jet Imaging System", Xerox Disclosure Journal, vol. 1, No. 3, Mar. 1976, p. 31.

"Printer-Recorder", IBM Technical Disclosure Bulletin, vol. 13, No. 9, Feb. 1971, pp. 2703-2704.

*Primary Examiner*—E. H. Eickholt

*Attorney, Agent, or Firm*—Jacox & Meckstroth

[57] ABSTRACT

This invention relates to apparatus and a method by which a liquid is applied in desired configurations to a continuous web which travels at a relatively high rate. The liquid may be that which is applied by jets or the like. According to this invention after the liquid is applied to the web excess quantities of fusible powder material are applied to the web during travel thereof. Some of the powder material adheres to the liquid, and powder material which does not adhere to the liquid is removed from the web prior to heating of the web to dry the liquid and to fuse the powder material.

The liquid which is applied to the web in desired configurations may be a clear or colorless liquid, such as water or the like. The liquid may be a water-base ink or the like. The powder material applied to the wet configurations provide desired color or aesthetic qualities or protective qualities to the configurations and to the web.

9 Claims, 4 Drawing Figures

APPARATUS AND METHOD FOR COATING OF INKS APPLIED AT HIGH SPEED

BACKGROUND OF THE INVENTION

Several types of apparatus are in use which are capable of variable printing at a relatively high rate of speed using computer formated information. Principal among these are ink jet and electrostatic laser printers. For example, printing processes which apply liquid droplets of ink from jets to a web are shown in U.S. Pat. Nos. 3,560,641 and 3,577,198. However, as known at this time, only black inks are applied by ink jet processes and apparatus. Such inks are limited to solutions of dye at low concentration in water. Thus, such inks must be free from particles and are thus not capable of carrying magnetic materials or other pigments which are needed for machine reading of the printed material. Furthermore, such inks, being limited to black color, are not capable of printing other desired colors.

Methods are known for fixing images consisting of dry powder on paper, such as shown in U.S. Pat. No. 3,640,749. However, such methods require the use of an aqueous dispersion of a film forming synthetic resin.

It is an object of this invention to provide an apparatus and a method for applying a coating to wet images to provide colors which are not necessarily black.

Another object of this invention is to provide an apparatus and a method in which particles are applied to the wet image and fused so that the printed material can be read by magnetic scanning or optical scanning means, or the like.

Another object of this invention is to provide such an apparatus and method by which raised printing can be produced at a high rate.

Another object of this invention is to provide printed images and/or coatings with high gloss, unique texture, fluorescence, and other aesthetic and functional features.

It is another object of this invention to provide such apparatus and method which does not require the use of synthetic resins.

Still another object of this invention is to provide an apparatus and method for manufacture of quality "hidden image" games and the like.

It is another object of this invention to provide apparatus and a method by which a waterproof, or an abrasion resistant or a non-erasable coating is applied to a printed web.

Another object of this invention is to provide such an apparatus and method by which, instead of conventional ink, a colorless liquid is applied in a desired configuration to a web and to which powdered material is then adhered to the wet image surface to provide color or magnetic qualities or the like to the configuration.

Another object of this invention is to provide an apparatus and method for producing a carbonless image transfer coating to the surface of a substrate.

Other objects and advantages of this invention reside in the construction and arrangement of parts and in the methods and modes of operation involved, as will become more apparent from the following description.

DETAILED DESCRIPTION OF THE INVENTION

Figure 1:
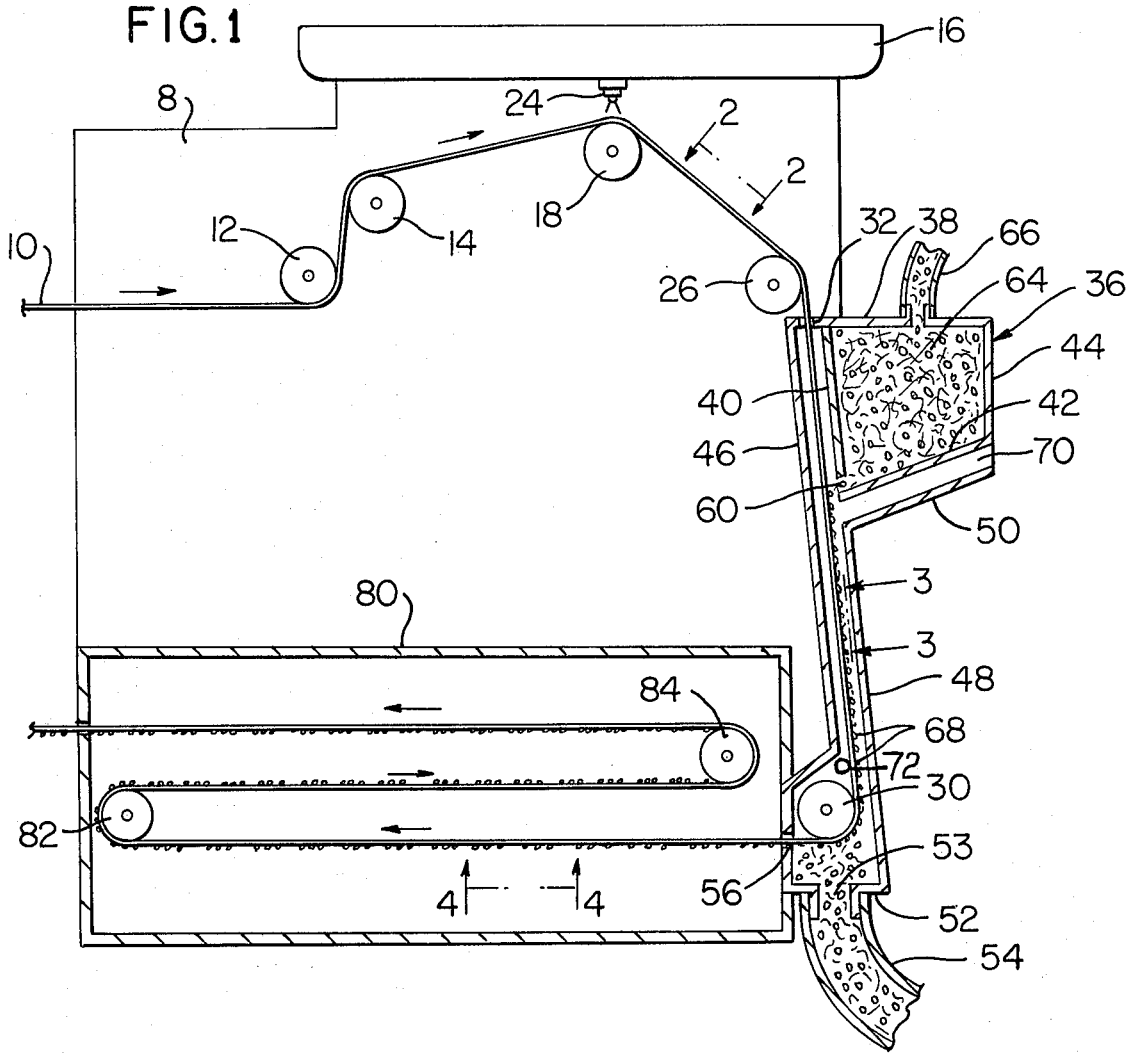
FIG. 1 is a diagrammatic side sectional view of coating apparatus constructed in accordance with this invention.

FIG. 1 illustrates diagrammatically support structure 8. A continuous web 10 moves over rolls 12 and 14 to an ink applying station 16. The rolls 12 and 14 are adapted to rotate at a rate such that successive portions of the continuous web 10 travel at a relatively high rate of speed. Adjacent the ink applying station 16 is a roll 18 over which the web 10 moves. As the web 10 moves in engagement with the roll 18, ink jets 24 apply ink to the web 10. The ink is applied in any desired configurations, such as in the form of words, numerals, figures, and the like.

Figure 2:
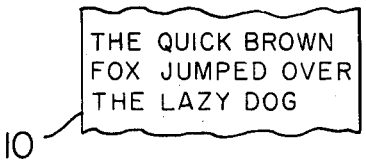
FIG. 2 is an enlarged diagrammatic elevational view taken substantially on line 2—2 of FIG. 1.

The web 10 then travels from the roll 18 to a roll 26. As the web 10 travels between the rolls 18 and 26 the printed configurations may appear somewhat in the manner illustrated in FIG. 2. Conventionally the ink applied by jet printing at a station such as the station 16 is black, and the ink is a water base ink, free from particulate material. Optionally the ink may contain other soluble materials such as wetting agents and binders.

The web 10 travels from the roll 26 to a roll 30. The rolls 26 and 30 are shown positioned so that the portion of the web 10 which extends between the rolls 26 and 30 is at a slight angular incline from the vertical. After the web 10 leaves the roll 26 the web 10 enters an elongate opening or slot 32 in a housing 36. The housing 36 has a top wall 38, an inner compartment side wall 40, an inner compartment bottom wall 42, and an inner compartment side wall 44. The housing 36 also has an outer wall 46, an outer wall 48, an outer wall 50 and an end wall 52. The end wall 52 has an opening 53 therein, which is in communication with a conduit 54 which is joined to the end wall 52. The outer wall 46 is shown as extending substantially the length of the housing 36 and has an elongate opening or slot 56 at the lower part thereof. The lower part of the housing 36 encloses the roll 30.

Figure 3:
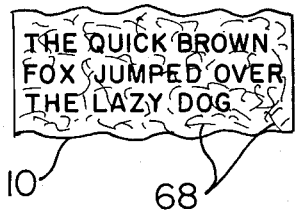
FIG. 3 is an enlarged diagrammatic elevational view taken substantially on line 3—3 of FIG. 1.

The web 10 enters the housing 36 through the elongate opening or slot 32 and then travels downwardly at a position between the wall 46 and the wall 40. As the web 10 enters the housing 36 through the slot 32, the portions of the web 10 to which the ink has been applied are wet. The lower part of the wall 40 has an elongate opening or slot 60 therein. The walls 38, 40, 42, and 44 form an inner compartment 64 in the housing 36. A conduit 66 is joined to the wall 38, and powder material 68 enters the inner compartment 64 through the conduit 66. The wall 42 is inclined so that powder material 68 within the inner compartment 64 readily flows therefrom through the slot or elongate opening 60. The powder material 68 falls upon the web 10. As portions of the web 10 move downwardly, powder material 68 in quantities in excess of those necessary to cover those wetted portions of the web 10 fall into engagement with the web 10. Some of the powder material 68 engages the wet ink configurations which are carried by the web 10, and such powder immediately adheres to the wet ink. Most of the powder material 68 which engages the web 10 at portions other than the wet ink configurations immediately falls from the web 10. However, as illustrated in FIG. 3, some of the powder material 68, other than that which covers the wet ink configurations, may remain on the web 10 as the web 10 moves downwardly from the position adjacent the slot 60.

The walls 42 and 50 form a passage 70 through which air flows into the housing 36. Air is drawn into the housing 36 as negative air pressure is applied to the conduit 54. Thus, air flows within the housing 36 between the walls 46 and 48 and forces some of the powder material 68 which is not in contact with the wet ink configurations to become detached from the web 10 as the web 10 moves downwardly toward the roll 30.

If desired or found necessary, a vibrating bar 72 is mounted in a position in contact with the web 10 adjacent the roll 30. The bar 72 vibrates the web 10 at this position, shaking loose any particles of the powder material 68 which may tend to adhere to the web 10 in areas not wetted by the ink configurations.

Figure 4:
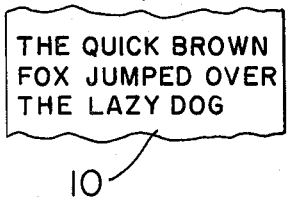
FIG. 4 is an enlarged diagrammatic elevational view taken substantially on line 4—4 of FIG. 1.

As each portion of the web 10 comes into engagement with the roll 30 the direction of travel of that portion of the web 10 is changed by at least ninety degrees. Due to the fact that the web 10 and the roll 30 are moving at a relatively high rate of speed, any remaining powder material 68 which is not in engagement with wet ink configurations is thrown from the web 10 as the web 10 moves around the roll 30. Thus, portions of the web 10 moving from the roll 30 have powder material 68 only on the wet ink configurations carried by the web 10, as illustrated in FIG. 4. Thus, there is no significant amount of powder material 68 carried by the web 10 from the housing 36, except the powder material 68 which adheres to the wet ink configurations upon the web 10. All powder material 68 expelled from the web 10 during travel thereof flows into the conduit 54 as vacuum is applied thereto, and the expelled powder material 68 may be recirculated to the compartment 64, if desired.

As the web 10 moves from the roll 30, the web 10 moves through the slot 56 and into a heater unit 80. Within the heater unit 80 the web 10 moves to a roll 82 and then to a roll 84 and then from the heater unit 80. As each portion of the web 10 moves from the heater unit 80 the ink applied thereto is dry and the powder material 68 which has been applied to the ink is solidified and firmly attached to the web.

The powder material 68 may be any suitable desired powder material. The powder material 68 preferably has a particle size in the range of 25 to 400 microns. However, satisfactory particle size may be in the range of 5 microns to 1000 microns. The powder material 68 may, for example, be that which is sold by Virkotype Corporation, Plainfield, New Jersey, and identified as Perma Rich Gold, or Perma Silver, or Gloss Coat, each having a particle size No. 14. The particle size is selected in accordance with the desired relief and the desired fineness of detail of the printed image. It is not necessary that all particles be in a given size range, but the powder material 68 may represent a mixture of particles covering the entire range stated. The powder material 68 is preferably of the type which has a melting point or fusing point in the range of 85 degrees to 120 degrees Centigrade. However, the melting point may be satisfactorily in the range of from 50 degrees to 300 degrees Centigrade. The powder material 68 may be of any desired color or may have an absence of color. Some or all of the particles of powder material 68 are fusible, but not all the particles of powder material 68 need to be fusible. The powder material 68 may be produced by dissolving or dispersing, respectively, a dye or a pigment in a resin or resin formulation, followed by grinding, spray chilling or the like to reduce the material to a fine powder. Alternatively, ground fusible resin powder may be dry-mixed with unfusible dye or pigment materials in fine particulate form. The powder material 68 may be that which provides a waterproof coating to the ink. The powder material 68 may be that which provides abrasion resistant or nonerasable qualities to the ink. The powder material 68 may be that which provides the inked configurations with magnetic or optically readable qualities. For example, most optical scanners are sensitive in the near infrared portion of the spectrum. Thus, images must contain colored material absorbent in the near infra-red if they are to be "visible" to the scanner. Therefore, in achieving the objects of this invention, the powder material 68 may function to enhance images or configurations by providing specific optical properties.

The powder material 68 may provide a coating with a specific function not related to optical properties. For example, the apparatus and method of this invention may be used to provide sheets in a carbonless copy system. The powder material 68 may comprise a mixture of fusible resin and/or wax particles and microcapsules containing liquid color reactant or chromogenic dye solution. When this powder material 68 is applied to a wetted surface and fused, a coating is produced which functions as one of a mated pair of coatings in a chemical carbonless copy system. This coating may be applied to the same side of a substrate as its mated coating, or it may be applied to the surface of a separate substrate. Thus, the powder material 68 which includes microcapsules may be adhered to a surface wetted by an ink containing phenolic resin, a zinc salt of a salicylic acid derivative, acid reactive clay, or other acidic color former, to provide a "self contained" carbonless copy product. Alternatively, the powder material 68 may be applied to a substrate wetted by an "inert" ink and the fused coating made to function as a coated back, "CB" coating by mating the thus coated sheet with another sheet having a coated front or coated face, "CF" coating.

Another example of a specific functional coating within the scope of this invention is the type used in "hidden number" games. In this type of product, a "winning number" or other image is printed, then covered by a removable coating. By rubbing, scratching, etc. the coating is removed to reveal the hidden image. The present invention provides a convenient means for producing a high quality product of this type by printing the image to be hidden, then overcoating that image and a surrounding area with another wet fluid of contrasting color, followed by application of a powdered formulation, removal of excess powder, followed by fusing and solidification of the powder. The powdered formulation is one which is selected to provide a frangible, removable coating.

The liquid material which is applied through the jets 24 at the ink applying station 16 may be a clear and colorless water or other liquid. Clear colorless water or other clear liquid does not clog the ink applying jets 24.

Clogged jets are a major cause of down time with ink jet printers. When clear colorless water or other liquid is used to provide wet configurations upon the web 10, it is not necessary to cover a black ink or the like in order to provide a desired color to the wet configurations. Furthermore, the clear colorless water is obtained at a low cost, and conventional ink storage and disposal problems are not present.

Although the preferred embodiment of the web coating apparatus and method of this invention has been described, it will be understood that within the purview of this invention various changes may be made in the form details, proportion and arrangement of parts, the combination thereof, and the methods of operation, which generally stated consist in the apparatus and/or method within the scope of the appended claims.

The invention having thus been described, the following is claimed:

1. Print apparatus in which a web has ink applied thereto in desired formations at a first station by ink jet print mechanism while the web travels at a high rate, the web moving from the first station to a second station and from the second station to a heat application station at a high rate, the ink being wet, watery, low-viscosity ink as it moves from the first station to the heat application station, comprising:

guide means at the second station for guiding travel of the web from an upper position to a lower position, and application means for applying fusible powder material to the web as the web travels from the upper position to the lower position, a portion of the fusible powder material adhering to the wet watery ink on the web, non-adhering fusible powder material falling downwardly and separating from the web prior to movement of the web to the heat application station, the adhering fusible powder material being fused at the heat application station, the powder material solidifying upon the web and adhering thereto in said desired formations, as the web moves from the heat application station.

2. Print apparatus of the type in which a rapidly moving web has wet watery, low-viscosity ink applied thereto by jet ink printing mechanism at a first station, the web traveling at a high rate from the first station to a second station and from the second station to a heat application station, the ink being wet and watery as the web travels from the first station to the heat application station, comprising:

a powder material application housing at the second station and positioned to direct travel of the web therethrough from an upper position to a lower position, the heat application station including a heated housing in juxtaposition with the powder material application housing and positioned horizontally laterally therefrom to receive the web as the web travels from the powder material application housing, pouring means within the material application housing for covering successive portions of the web with a fusible powder material as successive portions of the web travel downwardly through the powder material application housing, some of the fusible powder material which covers successive portions of the web adhering to the wet ink as the fusible powder material engages the web, fusible powder material which does not adhere to the wet ink falling downwardly within the powder application housing as the web travels downwardly therethrough, roller means within the powder application housing directing successive portions of the web to change direction of travel from a vertically inclined direction to a substantially horizontal direction and into the heated housing of the heat application station, so that remaining fusible powder material which does not adhere to the wet ink is discharged from the successive portions of the web as the successive portions change direction of travel, successive portions of the web traveling from the powder material application housing into the heat application housing at the heat application station, the wet ink being dried and the fusible powder material which is carried by the successive portions of the web being fused within the heat application housing, the successive portions of the web then traveling from the heat application housing, the powder material being solidified exterior of the heat application housing and providing a coating upon the web in the formation of the ink applied to the web at the first station.

3. Print apparatus provided with a print station at which low-viscosity wet watery ink is applied by ink jet mechanism to a continuous web to wet the web in desired wet liquid configurations as the continuous web travels at a high rate, there being a heat application station spaced from the print station, there being an intermediate station between the print station and the heat application station, comprising:

a housing at the intermediate station, the housing having a passage therethrough through which the web extends angularly downwardly from the print station to the heat application station, and powder application means for continuously pouring fusible powder material into the upper portion of the passage for engagement with the web, some of the fusible powder material adhering to the wet liquid configurations upon the web, non-adhering fusible powder material falling from the web as the web travels downwardly, the web thus moving from the intermediate station to the heat application station with powder material adhering to the wet liquid configurations, the adhering fusible powder material being fused at the heat application station.

4. The print apparatus of claim 3 in which the application means includes a compartment for containing powder material, the compartment being positioned within the upper portion of the housing, the compartment having a wall forming a portion of the passage, the wall having an opening therein from which powder material is discharged into the passage for engagement with the web.

5. The print apparatus of claim 3 which includes a guide roll within the housing and engageable by the web for changing the direction of travel of the web from a downward movement to a substantially horizontal movement, the web thus discharging non-adhering powder material therefrom as the web is engaged by the roll and as the direction of travel of the web is changed.

6. The print apparatus of claim 3 in which the application means includes a compartment for containing powder material, the compartment being positioned within the upper portion of the housing, the compartment having a wall forming a portion of the passage, the wall having an elongate horizontal opening therein from which powder material is discharged into the passage for engagement with the web, a roll within the passage of the housing and engageable by the web and changing the direction of travel of the web from a downward movement to a substantially horizontal movement, the web thus discharging powder material therefrom as the web engages the roll and as the direction of travel of the web is changed.

7. The print apparatus of claim 3 which includes means maintaining downwardly directed air flow within the passage for removing non-adhering powder material from the web.

8. Print apparatus in which a web travels at a high rate from a first station to a second station and then to a heat application station and then to a solidification station, comprising:

ink jet print mechanism at the first station for printing of wet, watery, non-tacky, low-viscosity ink in desired configurations upon the web, the web moving from the first station to a second station and from the second station to a heat application station at a high rate, the ink remaining a wet, watery, non-tacky, low-viscosity ink as it moves from the first station to the heat application station, guide means at the second station for guiding high rate travel of the web, powder application means at the second station for applying fusible powder material to the web and to the wet, watery, non-tacky, low-viscosity ink as the web travels at the second station, a portion of the fusible powder material, adhering to the wet, watery, non-tacky, low-viscosity ink on the web, the web then traveling to the heat application station, the portion of the fusible powder material which adheres to the wet, watery, non-tacky, low-viscosity ink, being fused at the heat application station, the web then traveling at a high rate to the solidification station, the powder material solidifying upon the web and adhering thereto in said desired configurations as the web moves at the solidification station.

9. The print apparatus of claim 8 in which the guide means positions the web for travel at a high rate from an upper position to a lower position at the second station.

* * * * *